US005090165A

United States Patent [19]

Kenny

[11] Patent Number: 5,090,165

[45] Date of Patent: * Feb. 25, 1992

[54] POLE AND POST SLEEVE OR BOOT

[76] Inventor: Loren D. Kenny, 718 Cedar St., Anaconda, Mont. 59711

[ * ] Notice: The portion of the term of this patent subsequent to Jun. 25, 2009 has been disclaimed.

[21] Appl. No.: 324,772

[22] Filed: Mar. 17, 1989

[51] Int. Cl.[5] ..... E02D 5/74

[52] U.S. Cl. ..... 52/165; 52/296; 52/298

[58] Field of Search ..... 52/165, 298, 296, 297

[56] References Cited

U.S. PATENT DOCUMENTS 1,234,893 7/1917 Fridley ..... 52/298

3,403,520 10/1968 Goodman ..... 52/298

FOREIGN PATENT DOCUMENTS 24494 2/1883 Fed. Rep. of Germany ..... 52/298

*Primary Examiner*—Richard E. Chilcot, Jr.
*Assistant Examiner*—Kien Nguyen
*Attorney, Agent, or Firm*—Richard C. Litman

[57] ABSTRACT

Disclosed is a sleeve or boot designed to encase a preformed base configured diametrically smaller than the remainder of a wooden post or pole, the sleeve or boot protecting and extending the life of the base when buried in the ground. In one embodiment the sleeve or boot may be formed by a coating of a suitable material such as plastic. In a second embodiment the sleeve or boot is preformed from suitable material such as plastic and includes an umbrella-like rim upon which a shoulder of the post or pole rests and which deflects excess moisture, and a pair of hooded vents which provide room for expansion in the event water within the sleeve or boot should freeze. The sleeve or boot may be attached to the base by a pair of galvanized pins.

5 Claims, 1 Drawing Sheet

POLE AND POST SLEEVE OR BOOT

FIELD OF THE INVENTION

This invention relates to a plastic sleeve or boot configured to fit over the base of wood posts and poles designed to be supported by holes in the earth. The plastic sleeve forms a barrier which greatly retards the decaying or rotting process of the wood post or pole, thereby increasing the longevity of the wood.

BACKGROUND OF THE INVENTION

For many, many decades upright wood posts and poles have been used as supports for such things as barbed wire, electric wire, telephone lines, wood fences, buildings, etc. All of these supports have had one thing in common, the decaying process of the wood. The life span of the wood post or pole has depended upon the type of wood used, whether the wood was treated with a preservative such as creosote, and of course, the climate conditions. In arid areas, wood posts last much longer than in areas which receive heavy rainfall throughout the year. In a desert area, a treated wood post or pole buried in the earth might last 15–20 years, whereas in very wet areas the same wood post or pole might not last five or six years before replacement is necessary.

SUMMARY OF THE INVENTION

It is an object of this invention to provide a sleeve or boot to fit over and encase the base of wood posts and poles designed for burial in the earth.

It is another object of this invention to provide a sleeve or boot to form a barrier between the base of wood posts and poles and the earth to thereby increase the longevity of the wood posts and poles.

These objects of the invention are satisfied by providing a preformed molded plastic sleeve or boot configured to fit over the base of a wood post or pole that is intended for burial in the earth. The shape of the plastic sleeve can be varied during the molding process in accordance with whether the base of the wood post or pole is round, square, or any other shape. It is contemplated that a barrier may also be achieved by a dipping process whereby the base of the wood posts or poles would be coated with plastic. Also, materials other than plastic may be used to form a barrier between the earth and the base of a wood post or pole. This invention is directed to any attachment to posts and poles to preserve the life span of the wood designated for burial in the earth.

Other objects, features and advantages of this invention will be apparent from the following detailed description and the appended claims, reference being had to the accompanying drawings forming a part of the specification, wherein like reference numerals designate corresponding parts of the several views.

DETAILED DESCRIPTION OF PREFERRED EMBODIMENTS

Before explaining in detail the present invention, it is to be understood that the invention is not limited in its application to the details of construction and arrangement of parts illustrated in the accompanying drawings, since the invention is capable of other embodiments and of being practiced or carried out in various ways. Also, it is to be understood that the phraseology and terminology employed herein is for the purpose of description and not limitation.

Figure 1:
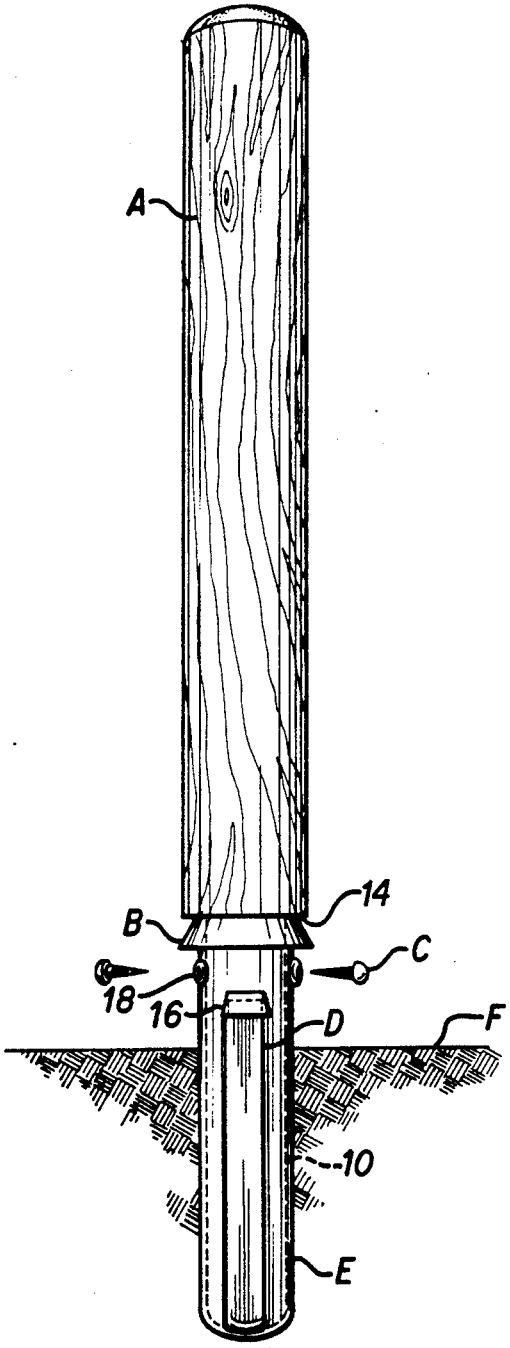
FIG. 1 is a view of a post or pole having a base encased in a protective sleeve.
Figure 3:
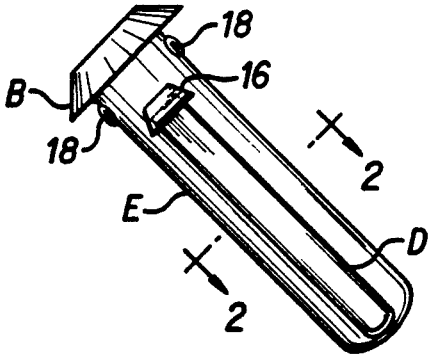
FIG. 3 is a side view of the protective sleeve.
Figure 4:
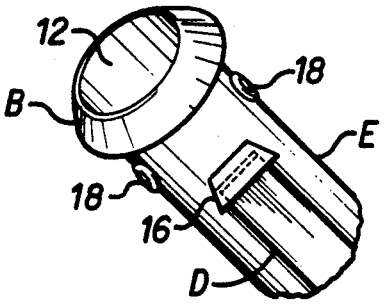
FIG. 4 is a perspective view of the protective sleeve.
Figure 2:
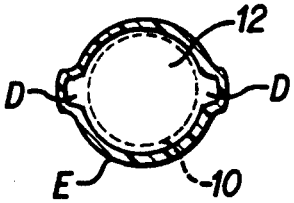
FIG. 2 is a cross-section view taken along line 2—2 of FIG. 3, showing two vents incorporated in the protective sleeve.

In FIG. 1, there is shown a wood pole or post A having a reduced circumferential base 10 inserted into an opening 12 in a protective sleeve or boot E preferably formed of molded plastic. While post A, base 10, opening 12 and protective sleeve E are shown to be cylindrical, they may be of any desired configuration, opening 12 being configured to cooperate with base 10.

The reduced size of base 10 provides post A with a shoulder 14 which rests snugly on an umbrella-like rim B at the top of sleeve E. The purpose of rim B is to deflect excess moisture which may run down the post away from protective sleeve E, thereby providing additional protection to the base 10 of post A. In the preferred embodiment the umbrella-like rim is located six to eight inches above the ground F.

Sleeve or boot E includes two vents D each covered by a hood 16 molded therein, extending from the base of the sleeve or boot E to several inches above ground level as shown in the several figures of the drawing. The purpose of the vents D is to provide an expansion area for freezing should any moisture accumulate in the sleeve or boot E.

Sleeve or boot E is connected to post A by means of galvanized pins C which are driven through preformed holes 18 in sleeve or boot E and into wood base 10.

The base 10 encased in sleeve E is buried in the ground F as shown in FIG. 1. The sleeve provides a protective barrier for the base, a support for maintaining the pole or post in an upright position, a means to deflect moisture away from the base of the pole or post, and an area for the expansion of ice in the event that moisture finds its way inside the sleeve.

While it will be apparent that the preferred embodiments of the invention herein disclosed are well calculated to fulfill the objects above-stated, it will be appreciated that the invention is susceptible to modification, variation and change without departing from the proper scope or fair meaning of the subjoined claims.

I claim:

1. A sleeve means for providing a protective barrier for a wood post or pole set in the ground, said post or pole having an upper portion and an integral base, said base being configured to have a smaller circumference than said upper portion, thereby forming a circumferential shoulder at the juncture of said upper portion and said base, said sleeve means comprising:

a central, axially aligned opening configured to receive and closely encase said base of said wood post or pole; and at least one vent means integral with said opening extending from a bottom of said sleeve means to a location near the top of said sleeve means; whereby when said base encased by said sleeve means is set in the ground said sleeve means forms a protective barrier between the ground and said base, thereby increasing the life expectancy of said base, said at least one vent means providing an expansion area for freezing of any moisture accumulated within the sleeve means.

2. A sleeve means according to claim 1, further comprising:

a hood for said at least one vent means to deflect external moisture away from said at least one vent means; and an umbrella-like rim at the top of said sleeve means configured to provide a support for said circumferential shoulder and to deflect external moisture away from said sleeve means.

3. A sleeve means according to claim 3, wherein:

said sleeve means is formed of plastic material;

there being at least two hooded vent means disposed diametrically opposite one another.

4. A sleeve means according to claim 2, further comprising:

at least two preformed holes in said sleeve means; and at least two galvanized pins passed through said preformed holes and into said base; whereby said post or pole and said sleeve means are locked together.

5. A sleeve means for providing a protective barrier for a wood post or pole set in the ground, said post or pole having an upper portion and an integral base, said base being configured to have a smaller circumference than said upper portion, thereby forming a circumferential shoulder at the juncture of said upper portion and said base, said sleeve means comprising:

a plastic sleeve having an axially aligned opening configured to closely encase said base of said post or pole;

an umbrella-like rim disposed at the top of said plastic sleeve for locating said shoulder of said post or pole a suitable distance above ground, said shoulder resting snugly on said umbrella-like rim, said umbrella-like rim deflecting excess moisture flowing from said upper portion of said post or pole away from said plastic sleeve whereby moisture is prevented from entering the plastic sleeve;

two vents molded into said plastic sleeve extending from the bottom of said plastic sleeve to nearly the top of said plastic sleeve, to provide an expansion area for freezing of moisture, should any moisture accumulate in said plastic sleeve;

two hoods provided respectively at the top of said vents to deflect external moisture away from the top of said vents;

two holes formed in the top of said plastic sleeve for two galvanized pins hammered through said formed holes into the wood base so as to lock said plastic sleeve to said wood base, whereby said post or pole cannot be readily separated from said plastic sleeve; and said plastic sleeve providing a protective barrier between the ground and said base, and a support for said post or pole, when said base and said plastic sleeve are set into the ground.

* * * * *